United States Patent [19]

Jay

[11] Patent Number: 5,018,790

[45] Date of Patent: May 28, 1991

[54] CUSTOMIZED SEAT CUSHION

[75] Inventor: Eric C. Jay, Boulder, Colo.

[73] Assignee: Jay Medical, Ltd., Boulder, Colo.

[21] Appl. No.: 491,554

[22] Filed: Mar. 12, 1990

Related U.S. Application Data

[63] Continuation of Ser. No. 221,639, Jul. 20, 1988, abandoned.

[51] Int. Cl.[5] ..... A47C 7/14

[52] U.S. Cl. ..... 297/458; 297/284; 297/459; 297/DIG. 6; 5/446

[58] Field of Search ..... 297/284, 452, 458, 459, 297/DIG. 1-3, DIG. 6; 5/446, 447

[56] References Cited

U.S. PATENT DOCUMENTS

| | | | |
|---|---|---|---|
| 3,279,849 | 10/1966 | Radke et al. | 297/DIG. 6 X |
| 3,495,871 | 2/1970 | Resag et al. | 297/284 |
| 3,751,111 | 8/1973 | Taylor et al. | 297/457 X |
| 4,588,229 | 5/1986 | Jay | 297/459 |
| 4,628,557 | 12/1986 | Murphy | 5/446 |
| 4,637,651 | 1/1987 | Sperr | 297/459 X |
| 4,643,481 | 2/1987 | Säloft et al. | 297/DIG. 2 X |
| 4,718,727 | 1/1988 | Sheppard | 297/459 X |
| 4,726,624 | 2/1988 | Jay | 297/452 |
| 4,761,011 | 8/1988 | Sereboff | 297/284 X |

*Primary Examiner*—Peter R. Brown

*Attorney, Agent, or Firm*—Cook, Egan, McFarron & Manzo, Ltd.

[57] ABSTRACT

A customized seat cushion for the human body comprises securable, removable supports which are used in combination with a shaped tray and a pad containing a fluid filling material. In the preferred embodiment, the supports are fastened to selected contours of the shaped tray, and the surface presented by the supports and shaped tray are covered by the pad which is fastened to the exposed surfaces of the tray and pads to form a customized seat cushion.

28 Claims, 2 Drawing Sheets

CUSTOMIZED SEAT CUSHION

This is a continuation of copending application Ser. No. 07/221,639 filed on July 20, 1988, abandoned.

BACKGROUND OF THE INVENTION

Severely disabled persons, particularly those confined to wheelchairs are prone to develop posture problems and deformities. If not corrected, improper or inadequate positioning can further exacerbate posture deformities. It has been estimated that 90% of persons who have been confined to wheelchairs, for two years or more, develop one or more posture deformities.

When a person's disability requires confinement to a wheelchair, various posture problems can result as a consequence of improper seating or positioning in the chair. For example, leaning to one side in a wheelchair can cause a condition known as pelvic obliquity, which results in one hip being lower than the other. If left uncorrected, pelvic obliquity often causes the person to develop scoliosis, an abnormal and severe curvature of the spine, and pressure sores. Slouching can lead to kyphosis, an abnormal backward curvature of the spine. Consequences of kyphosis include increased pressure on the coccyx and if carried to the extreme, a tendency to slip off the seat and possibly out of the chair. Further positioning or posture problems include abduction or adduction of the legs (the legs are either too far apart or too close together) and windswept hips (one hip is forward and the legs are swept to the opposite side), which can also lead to physical deformities. In children, these problems are particularly devastating because the deformity can become permanent within months if not corrected.

The prior art has attempted to alleviate positioning and posture problems with custom-designed wheelchairs which adjust to allow proper positioning of the legs, hips, torso, etc. and which are custom designed and built to alleviate the particular posturing difficulties of a specific patient. The advantage of this system is that it is immediately adjustable to the positioning needs of a specific patient and allows for body growth and other changes in the physical condition. However, this system is extremely cumbersome and expensive. Further, an individual's disability is accentuated by the increased equipment surrounding him. Finally, the increased equipment makes physical contact, such as hugging, difficult.

The prior art has attempted to alleviate the problems encountered with such custom-designed wheelchairs with custom molded seat cushions, such as the Pin Dot custom foam system. Custom molded cushions are designed and molded to meet the specific posturing needs of a particular patient. These attempts are successful to a limited extent. However, custom molding is a time consuming and expensive procedure and does not allow for on the spot correction of seating or posturing problems and is not flexible to a person's physical changing needs. Finally, in the case of a disabled child, a custom molded cushion does not allow for growth and in a few months time is obsolete for the particular physical needs of that child.

Problems with seat stability are also particularly critical with respect to wheelchair users. A cushion which provides for correct posture and thus stable seating enhances the users ability to wheel and turn the chair by grasping the wheels, to get in and out of the chair, to reach the floor to pick up an object and other types of movements. A cushion which lacks stability creates a fear of falling from the chair which will inhibit the user's range of movement. However, a seat cushion which provides a stable and comfortable seat and which assists in proving correct posture, will improve the user's equilibrium and sense of orientation.

The custom-designed cushions of the present invention overcome the foregoing problems as is more fully described below.

SUMMARY OF THE INVENTION

The present invention relates to customizable seat cushions and more particularly to a contoured or shaped tray or base whose effective contours can be selectively augmented by addition of removably securable anatomically shaped supports and covered with a pressure relieving pad containing a fluid filling material to present a customized, comfortable posture correcting, pressure relieving seat cushion specific to the particular and changing physical needs of an individual.

In the preferred embodiment, the shaped tray has upwardly extending rims on both sides and a modified rim at the front (with areas to accommodate the legs of the user of the cushion), but the tray is preferably open in the rear to avoid placing any pressure on the ischial tuberosities (seat bones) or the coccyx (tail bone), or the back during reclining. The opening in the rear should be at least six inches wide, and may extend across the entire width of the traY. Preferably the front rim is deep enough (as measured from front to back) to provide support for the user's legs and includes two areas of somewhat reduced elevation to accommodate the user's legs. The rims of the tray function to generate supporting pressures, through the flowable filling material, in areas of the body other than the ischia or seat bones.

The removably securable supports can be selectively placed over and adhered to the side rims, the modified front rim and the central rise to augment the general shape of each of those areas and consequently provide more aggressive positioning of a human being on the cushion.

In the preferred embodiment, the supports consist of two mirror image wedge shaped supports adapted to be placed on the upper most front corners of the front rim to adduct or maintain one or both of the user's legs within leg support areas; two mirror image modified wedge shaped hip guides adapted to be adhered to the back corner side rims of the tray and following the concave curve of the slope of the side rims to guide and maintain the user's hips into the depressed area; two mirror image "pelvic obliquity" supports adapted to be adhered to the back corners of the side rims of the tray and providing an augmented or built up surface to raise one side of the pelvis and prevent problems associated with leaning; and a generally bulbous shaped support, contoured and adapted to be secured to and augment the central rise of the front rim to separate the user's legs and urge the user's legs into their respective support areas.

In the preferred embodiment, the top and bottom surfaces of the supports are equipped with fabric hook and look fasteners, such as velcro strips to secure the selected supports to their respective areas and to secure the pad to the augmented tray. Other means of fastening include the use of glue to glue the supports into place.

In one embodiment, the pad which is adapted to contain the fluid filling material, is a flexible envelope fabricated from an extensible elastomeric material, such as thermoplastic polyurethane film. The fluid filling material is preferably a high viscosity, thixotropic material which will flow under pressure, but which will maintain its shape in the absence of pressure.

The flexible envelope containing the fluid filling material is anchored to the exposed surfaces of the tray and supports and the underlying tray in such a manner that it is restrained from sliding forward. This anti-sliding restraint, in combination with the other seat design features described herein, reduces the tendency of the user to slide forward and the consequential slumping deformities. Basically, through fastening the cushion, the tendency of the cushion to slip forward is obviated and the consequent tendency of the user to slip forward is substantially eliminated.

Moreover, the other features of the cushion also cooperate to reduce the tendency to slump. It is well known that slumping is a reaction to nonstability. An envelope filled with a non-compressible thixotropic filling produces a much more stable seat, which decreases the tendency toward slumping which occurs when a person is seated on an unstable surface. Moreover, in the preferred embodiment, the tray which has a slightly raised portion for the legs and a depressed portion for the ischial tuberosities also has a marked tendency to reduce the tendency to slump, as the seat portion of the cushion is slightly lower than the leg portion in the preferred embodiment.

DETAILED DESCRIPTION OF THE INVENTION

Figure 1:
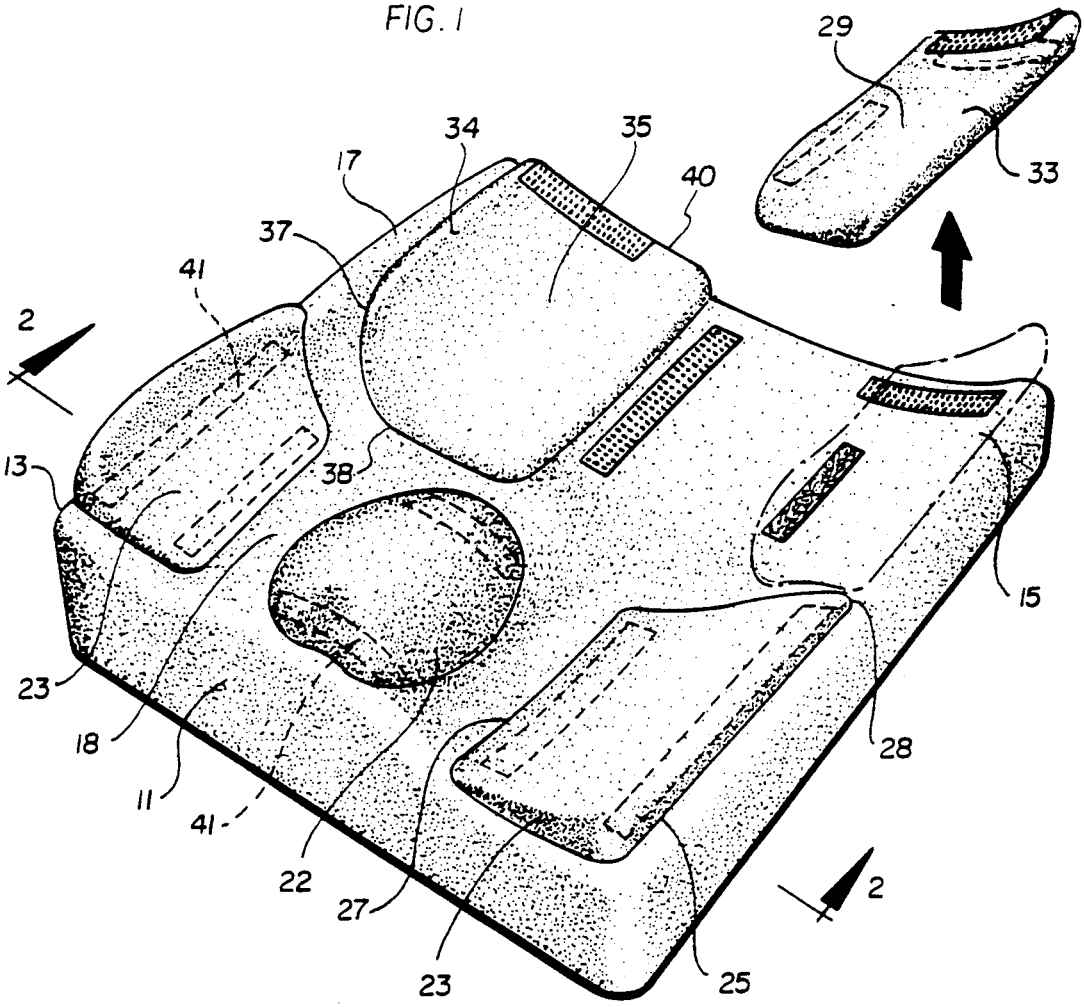
FIG. 1 is an isometric view of the seat cushion combination illustrating supports adhered to the shaped tray and illustrating a support, separated from, but juxtaposed above, the shaped tray.
Figure 3:
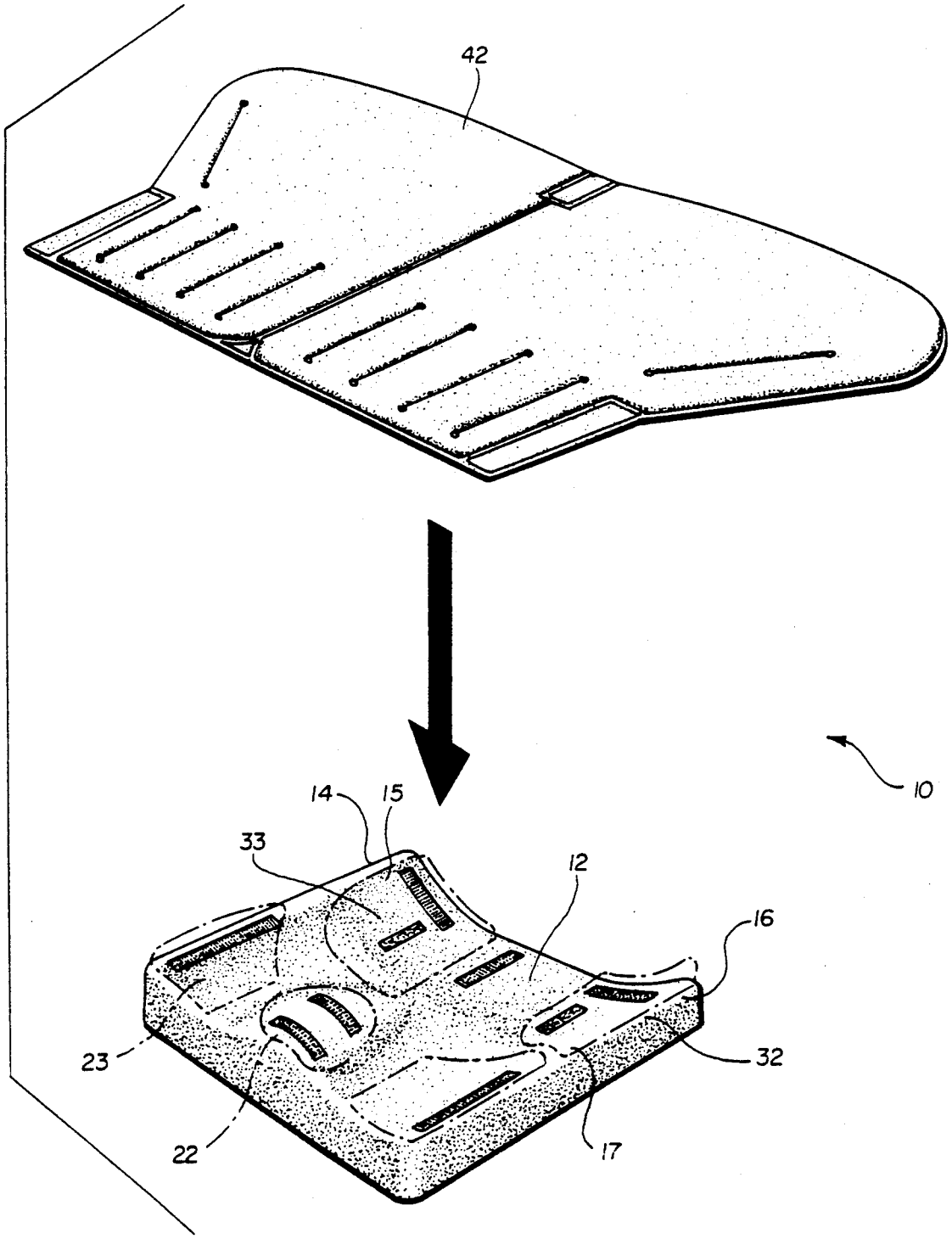
FIG. 3 is an isometric view of the seat cushion combination illustrating the pad separated from, but juxtaposed above, the shaped tray.

The combination seat cushion 10, without pad 20 is shown in FIG. 1. The combination seat cushion is shown in FIG. 3. Seat cushion 10 is generally comprised of pad 20, tray 40 and any combination of supports 22, 23, 29, and 34.

The Shaped Tray

Tray 11 is preferably a relatively rigid, but light weight material. While urethane foams of various density have been employed, the tray could be manufactured from any convenient material such as plastic, wood, metal, or the like. It is generally desired to include a non-slip lower surface (not shown) and built in (e.g. molded) carrying handles (not shown). The tray must be wide enough to support a human being. Trays of about 15.5 inches or 18 inches width are suitable because they fit most persons and may be used in standard size wheelchairs. Smaller sizes, such as 12 inch or 14 inch width may be fabricated for children. The invention is not limited to any specific size.

The shape of the tray 11 is critical. It is generally essential to have depressed seat area 12 surrounded by rims 14 and 16 on each side and rim 18 on the front. A modified front rim 18 is preferably deeper, e.g., (extends from a front edge approximately 40% of the distance of the back edge of the tray) with a central rise 19 adapted to spread the user's legs and urge the user's legs into support areas 20. The rear portion of the tray should be open, i.e., no rim at the back in order to avoid building pressure in the area of the coccyx. Because the distance between the ischial tuberosities in adults is between 4.5 and 6 inches, the cut out at the rear of the tray must be at least 6 inches wide, and is preferably at least 8 inches wide in order to provide for a certain amount of shifting from side to side of the user. Generally it is desired that the user have from 1 to 3 inches room to shift from side to side and from 1 to 5 inches room to shift from front to back. This allows the user to shift position without developing any undesired pressures from the tray.

Figure 2:
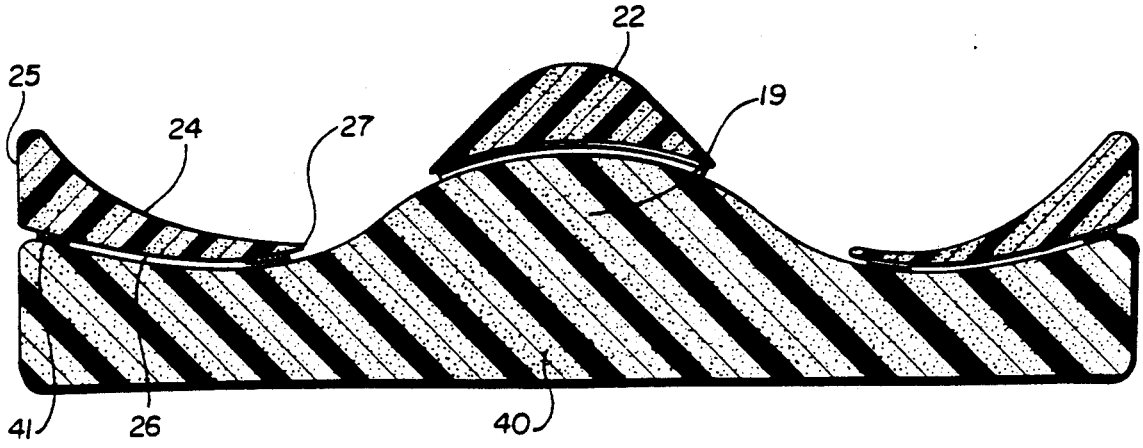
FIG. 2 is a cross sectional front view of the seat cushion.

As shown in FIGS. 2 and 3, the side rims 14 and 16 are essentially vertical on the outside of tray 11, but are sloped inwardly, generally toward the seat portion 12 on the inside of the tray. Similarly, the front rim 18 is relatively vertical on the outside at tray 10, but sloped gradually inwardly and downwardly toward the seating area 12, on the inside of the tray.

This tray is of the sort disclosed in U.S. Pat. Nos. 4,588,229 and 4,726,624.

The Supports

In the preferred embodiment, the supports 22, 23, 29, and 34 are preferably a relatively rigid, lightweight material. While urethane foams of varying density have been used, the supports can be manufactured from any convenient material such as plastic, wood, metal or the like.

Depending on the positioning or posturing needs of a person, one or more of the supports may be adhered to the tray 11, thereby enhancing or exaggerating the contours of the tray to assist in the correction of a specific posture problem. A support may be used alone or in varying combinations with any of the other supports.

Generally, the supports must be shaped to cooperate with and augment the contours of the tray while providing a smooth and comfortable seating surface.

In the preferred embodiment, support 22, has a generally bulbous upper shape and a base contoured to the shape of the central rise 19, cooperates with the central rise 19, and is adapted to spread the user's legs and urge the user's legs into support areas 20. The bulbous protrusion of support 22 from the central rise 19 prevents the user's legs from coming too closely together and prevents one leg from sliding over the central rise 19 into the other leg's support area 20.

In the preferred embodiment, support 23 is generally wedged shaped, having a concave upper face 24, a vertical face 25 and a flat bottom face 26 substantially perpendicular to the vertical face 25. The upper concave face 24 and the flat bottom face 26 meet to form an apex 27, and depending from an end 31 is a point 28 formed by the apex 27 approaching the vertical face 25 in a manner whereby a blunt tip is formed. The flat bottom face 26 is fastened to and cooperates with the front corner 13 portions of the tray with the blunt tip pointing towards the back of the tray. When in place, support 23 presents a surface that is upwardly curving in the sides of the front corners of the tray which urges the user's legs into the support areas 20 and prevent the user's legs from spreading too far apart or slipping over the sides of the tray 11.

In the preferred embodiment, support 29 has a compound upper surface 30 which is substantially concave and a compound bottom surface 31 approximately contoured to matingly engage one or both of the side rims 14 and 16 of the tray. Support 29 is adhered to the back corner portions 15 and 17 of the tray following from the top 32 of the rims 14 and 16 down the slope of the rim 33 to where the rim meets the depressed seating area so that when installed the upper surface of support 29 substantially smoothly converges with the exposed surface of the depressed seating area 12 in such a manner that the transition from the upper surface 30 of the support to the surface of the tray is smooth and precludes presentation of a pressure point. Support 29 engages either or both hip areas of the user to prevent the hips of the user from sweeping to either side of the seating area 12.

In the preferred embodiment, support 34 has two substantially parallel upper 35 and lower faces 36. The lower face 36 curves upwardly to intersect the upper face 35 at the front 37 and first side 38 of the support 34. The upper face 35 curves downwardly to intersect the lower face 36 on a second side 39. The rear 40 of the support is a planar surface substantially perpendicular to the upper 35 and lower 36 faces. Support 34 is adapted to be adhered to either or both of the back outer corners 15 and 17 of the tray. When installed support 34 elevates the inner slope 33 of the rims 12 and 14 from the top of the rim 32 to where the rims 14 and 16 and the depressed seating 12 area meet and presents a more plane surface than the existing surface of the rim slope. Support 34 is designed to raise one side of the pelvis of the user to a point level with the other side to prevent pelvic obliquity and ultimately scoliosis.

Depending on the particular posturing needs one of more of the supports ma be used to alter the seating surface of the tray to effect a particular posture correcting surface.

In the preferred embodiment, supports 22, 23, 29, and 34 are equipped with fasteners 41, such as velcro, on both upper and lower faces to fasten two supports to the tray and to provide a non-slip surface for the pad.

The Pad

In the preferred embodiment, the pad 42 is an envelope fabricated from an elastic material and contains fluid filling material such as a highly viscous liquid, i.e., plastic or viscous thixotropic material, but which maintains its shape and position in the absence of pressure. One such viscous fluid is commercially available under the trade name FLOLITE , the registered trademark of Alden Laboratories. ALthough FLOLITE is a preferred fluid, fluids such as water and air also may be utilized. Other suitable flowable materials are described and claimed in: U.S. Pat. Nos. 4,229,546 and 4,243,754. Representative pads which may be used with this invention are described in U.S. Pat. Nos. 4,588,229 and 4,726,624.

The pad 42 need not be attached to the tray 11, but such attachment is preferred. Center attachment 43, which may be a fabric hook and loop fastener, at the rear of the pad is desired in order to prevent the pad from slipping forward, as this may be the sole attachment means. Preferably the rear edge of the pad is also attached to the inward sloping portion of side rims with velcro strips 41.

This invention can also be adapted to a seat back cushion for positioning and posture correction of the back and/or neck of a seated individual.

From the foregoing description, it is apparent that the present invention provides a customizable seat cushion which may be adapted to suit the particular positioning needs of an individual in a wheelchair. While the preferred embodiment has been described, it should be understood that various changes, modifications, and adaptations may be made therein without departing from the spirit of the invention and the scope of the appended claims.

What is claimed is:

1. A seat cushion for supporting a human body and customizable assisting in the correction of posture and the prevention of development of posture deformities over time, while reducing the buildup of pressure over the bony prominences of the body, said seat cushion comprising:

a tray having a depressed area situated beneath a user's ischial tuberosities, said tray having a plurality of rims, each of said plurality of rims sloping downwardly from an outer edge of the cushion toward said depressed area, said plurality of rims including a front rim having a central rise;

a discrete anatomically shaped support, removably secured to said front rim, said support being of a generally rigid material and wherein attachment of said support to said front rim presents a substantially concave posture correcting surface toward the center of said front rim, said substantially concave surface being a part of said posture correcting surface; and a pad juxtaposed over said tray and said supports, said pad comprising a flexible envelope containing a fluid material.

2. The seat cushion of claim 1, wherein said support is secured to said front rim by fabric hook and loop fastening means.

3. The seat cushion of claim 1, wherein said fluid material is a viscous liquid which flows gradually under pressure but which maintains its shape and position in the absence of pressure.

4. The seat cushion of claim 1 wherein said fluid material is a gas.

5. A system for correcting posture in human beings, said system comprising:

a base means for supporting the system;

said base means presenting a seating surface contoured to provide vertical and lateral support to a human being in a seated position;

said base means having a depressed area bounded by a plurality of lateral support surfaces and a frontal support surface;

a discrete anatomical support means removably secured to said frontal support surface for selectively presenting posture correcting surfaces, said support means being selectably attachable to said base means in varying positions to establish a desired posture correcting contour, wherein attachment of said support presents a substantially concave surface toward the center of said frontal support surface;

a pad means for presenting a pressure compensating seating surface;

said pad means being removably securable to exposed surfaces presented by said desired posture correcting contour.

6. The posture correcting system of claim 5 wherein said support is secured to said frontal support surface by fabric hook and loop fastening means.

7. The system for correcting posture of claim 5 wherein said fluid material is a viscous liquid which flows gradually under pressure but which maintains its shape and position in the absence of pressure.

8. The system for correcting posture of claim 5 wherein said fluid material is a gas.

9. A seat cushion for supporting a human body and customizable assisting in the correcting of posture and the prevention of development of posture deformities over time, while reducing the buildup of pressure over the bony prominences of the body, said seat cushion comprising:

a tray having a depressed area situated beneath a user's ischial tuberosities, said tray having a plurality of rims, each of said plurality of rims sloping downwardly from an outer edge of the cushion toward said depressed area, said plurality of rims including a front rim disposed between two side rims, said front rim having a central rise;

a discrete anatomically shaped support, removably secured to each of said rims, said supports being of a generally rigid material, wherein attachment of said supports to said rims presents a substantially concave surface toward said depressed area, said concave surface being a part of said posture correcting surface; and a pad juxtaposed over said tray and said supports, said pad comprising a flexible envelope containing a fluid material.

10. The seat cushion of claim 9 wherein said support means is secured to said rims by fabric hook and loop fastening means.

11. The seat cushion of claim 9 wherein said fluid material is a viscous liquid which flows gradually under pressure but which maintains its shape and position in the absence of pressure.

12. The seat cushion of claim 9 wherein said fluid material is a gas.

13. A seat cushion for supporting a human body and customizable assisting in the correction of posture and the prevention of development of posture deformities over time, while reducing the buildup of pressure over the bony prominences of the body, said seat cushion comprising:

a tray having a depressed area situated beneath a user's ischial tuberosities, said tray having a plurality of rims, each of said plurality of rims sloping downwardly from an outer edge of the cushion toward depressed area, said plurality of rims including a front rim having a central rise;

a discrete anatomically shaped support, removably secured to said central rise, said support being of a generally rigid material and wherein attachment of said support to said central rise effectively convexly extends said central rise; and a pad juxtaposed over said tray and said support, said pad comprising a flexible envelope containing a fluid material.

14. The seat cushion of claim 13 wherein said support is secured to said central rise by fabric hook and loop fastening means.

15. A seat cushion of claim 13 wherein said fluid material is a viscous liquid which flows gradually under pressure but which maintains its shape and position in the absence of pressure.

16. The seat cushion of claim 13 wherein said fluid material is a gas.

17. A system for correcting posture in human beings, said system comprising:

a base means for supporting the system;

said base means presenting a seating surface contoured to provide vertical and lateral support to a human being in a seated position;

said base means having a depressed area bounded by a plurality of lateral support surfaces and a frontal support surface;

a discrete anatomical support means removably secured to said lateral support area for selectively presenting posture correcting surfaces, said support means being selectably attachable to said base means in varying positions to establish a desired posture correcting contour, wherein attachment of said support presents a substantially concave surface toward said depressed area;

a pad means for presenting a pressure compensating seating surface;

said pad means being removably securable to exposed surfaces presented by said desired posture correcting contour.

18. The system for correcting posture of claim 17, wherein said support means is secured to said lateral support area by fabric hook and loop fastening means.

19. A system for correcting posture of claim 17 wherein said pad means contains a viscous liquid which flows gradually under pressure but which maintains its shape and position in the absence of pressure.

20. The system for correcting posture of claim 17 wherein said pad means contains a gas.

21. A system for correcting posture in human beings, said system comprising:

a base means for supporting the system;

said base means presenting a seating surface contoured to provide vertical and lateral support to a human being in a seated position;

said base means having a depressed area bounded by a plurality of lateral support surfaces and a frontal support surface and having a leg separating means is integrally formed with said frontal surface;

a discrete anatomical support means removably secured to said leg separating means for selectively presenting posture correcting surfaces, said support means being selectably attachable to said base means in varying positions to establish a desired posture correcting contour wherein attachment of said supports associated with said leg separating means effectively convexly extend said leg separating means;

a pad means for presenting a pressure compensating seating surface;

said pad means being removably securable to exposed surfaces presented by said desired posture correcting contour.

22. The system for correcting posture of claim 21 wherein said support means is secured to said frontal support surface by fabric hook and loop fastening means.

23. A system for correcting posture of claim 21 wherein said pad means contains a viscous liquid which flows gradually under pressure but which maintains its shape and position in the absence of pressure.

24. The system for correcting posture of claim 21 wherein said pad means contains a gas.

25. A seat cushion for supporting a human body and customizable assisting in the correction of posture and the prevention of development of posture deformities over time, while reducing the buildup of pressure over the bony prominences of the body, said seat cushion comprising:

a tray having a depressed area situated beneath a user's ischial tuberosities, said tray having a plurality of rims, each of said plurality of rims sloping downwardly from an outer edge of the cushion toward said depressed area, said plurality of rims including a front rim disposed between two side rims, said front rim having a central rise;

a discrete anatomically shaped support, removably secured to each of said rims, said support being of a generally rigid material and wherein attachment of said support to said rims presents a substantially concave surface toward said depressed area, said concave surface being a part of said posture correcting surface; and a pad juxtaposed over said tray and said supports, said pad comprising a flexible envelope containing a fluid material; and secured to one of said rims, said support being of a generally rigid material.

26. The seat cushion of claim 25 wherein said support is secured to said rims by fabric hook and loop fastening means.

27. The seat cushion of claim 25 wherein said fluid material is a viscous liquid which flows gradually under pressure but which maintains its shape and position in the absence of pressure.

28. The seat cushion of claim 25 wherein said fluid material is a gas.

* * * * *